US006948427B2

(12) United States Patent
Boucher et al.

(10) Patent No.: US 6,948,427 B2
(45) Date of Patent: Sep. 27, 2005

(54) WEB INFEED DEVICE FOR ROTARY PRINTING PRESSES

(75) Inventors: Ronald Henry Boucher, Goffstown, NH (US); Lev Zlatin, Portsmouth, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/190,444

(22) Filed: Jul. 5, 2002

(65) Prior Publication Data

US 2004/0003731 A1 Jan. 8, 2004

(51) Int. Cl.[7] ..... B41F 13/54

(52) U.S. Cl. ..... 101/228; 101/219; 101/232; 226/91; 226/32

(58) Field of Search ..... 101/228, 227, 101/219, 232, 485, 486; 226/91, 92

(56) References Cited

U.S. PATENT DOCUMENTS

| | | | | |
|---|---|---|---|---|
| 4,987,830 A | | 1/1991 | Fukuda et al. | |
| 5,320,039 A | | 6/1994 | Reponty et al. | |
| 5,809,892 A | * | 9/1998 | Kruger et al. | 101/483 |
| 5,947,361 A | * | 9/1999 | Berger et al. | 226/92 |
| 5,967,036 A | | 10/1999 | Marmin et al. | |
| 6,398,094 B1 | * | 6/2002 | Alexander | 226/92 |

* cited by examiner

*Primary Examiner*—Andrew H. Hirshfeld
*Assistant Examiner*—Kevin D. Williams
(74) *Attorney, Agent, or Firm*—Davidson, Davidson & Kappel, LLC

(57) ABSTRACT

A web infeed device for rotary printing presses includes a pointed nose piece having concave side portions. The flexible infeed element is received in a guide, and driving elements are provided for driving the infeed element along the guide.

17 Claims, 9 Drawing Sheets

WEB INFEED DEVICE FOR ROTARY PRINTING PRESSES

BACKGROUND OF THE INVENTION

The present invention relates generally to printing devices and more particularly to a web infeed device for rotary printing devices.

U.S. Pat. No. 5,967,036 describes a web infeed device for rotary printing presses, which permits a web to be fed through the printing press. A flexible, finite infeed element for holding a lead edge of a web runs in a guide or track. Balls are inserted in openings of the infeed element at spaced-intervals, and travel within a cross-cut in the guide. Drive elements can drive the balls and thus move the infeed element through the printing press to feed the web. U.S. Pat. No. 5,967,036 is hereby incorporated by reference herein. It has been known for the tip of the infeed element described therein to jam in the guide, for example in curves or gaps.

U.S. Pat. No. 5,320,039 discloses a web engagement system for an off-reel printing press in which a guide piece is accommodated in a guide channel. The guide piece preferably is a flexible plastic section with a square cross-section. The front part is tapered and a rear part is split.

U.S. Pat. No. 4,987,830 discloses a paper feed device for rotary presses having a spindle shaped linear member. The linear member is made of synthetic resin or leather, with caps being made of a rather hard material.

The devices of the '039 and '830 are long flexible members that ran in guides and contact the guides over a large length. The friction generated by flexible members passing over a curved section is subject to what is known as the capstan effect, which causes frictional forces to increase exponentially as the flexible member wraps around the surface.

BRIEF SUMMARY OF THE INVENTION

An object of the present invention is to provide a web infeed device with reduced friction and improved feeding properties.

The present invention provides a web infeed device for rotary printing presses comprising an infeed element having a flexible section and a pointed nose piece having concave side portions; a guide, the flexible infeed element being received in the guide; and driving elements for driving the infeed element along the guide.

The nose piece of the present invention with the concave side portions provides for excellent feeding while reducing friction with the guide.

The flexible section preferably includes a flat band-shaped metal piece. The band-shaped piece may include holes, and balls located in the holes.

The pointed nose piece preferably is made of rigid material, and preferably has a cut out at a rear end for receiving the band-shaped metal piece.

A rear section of the nose piece preferably is curved, to aid in rearward movement of the infeed element.

Preferably, the nose piece is symmetrical about a longitudinal plane, preferably a plane defined by the flexible section. Most preferably, the nose piece is fully symmetrical about a longitudinal axis.

The present invention also provides a web infeed device for rotary printing presses comprising an infeed element having a flexible band-shaped section and a rigid pointed nose piece connected to the flexible band section; a guide, the flexible infeed element being received in the guide; and driving elements for driving the infeed element along the guide.

By using a rigid pointed nose piece in conjunction with the flexible band section, excellent feeding with reduced friction can be provided.

The present invention also provides a web infeed device for rotary printing presses comprising an infeed element having a first flexible section, a second flexible section and a connecting piece having concave side portions connecting the first flexible section to the second flexible section; a guide, the flexible infeed element being received in the guide; and driving elements for driving the infeed element along the guide.

BRIEF DESCRIPTION OF THE DRAWINGS

Preferred embodiments of the present invention are described below by reference to the following drawings, in which.

DETAILED DESCRIPTION

Figure 1:
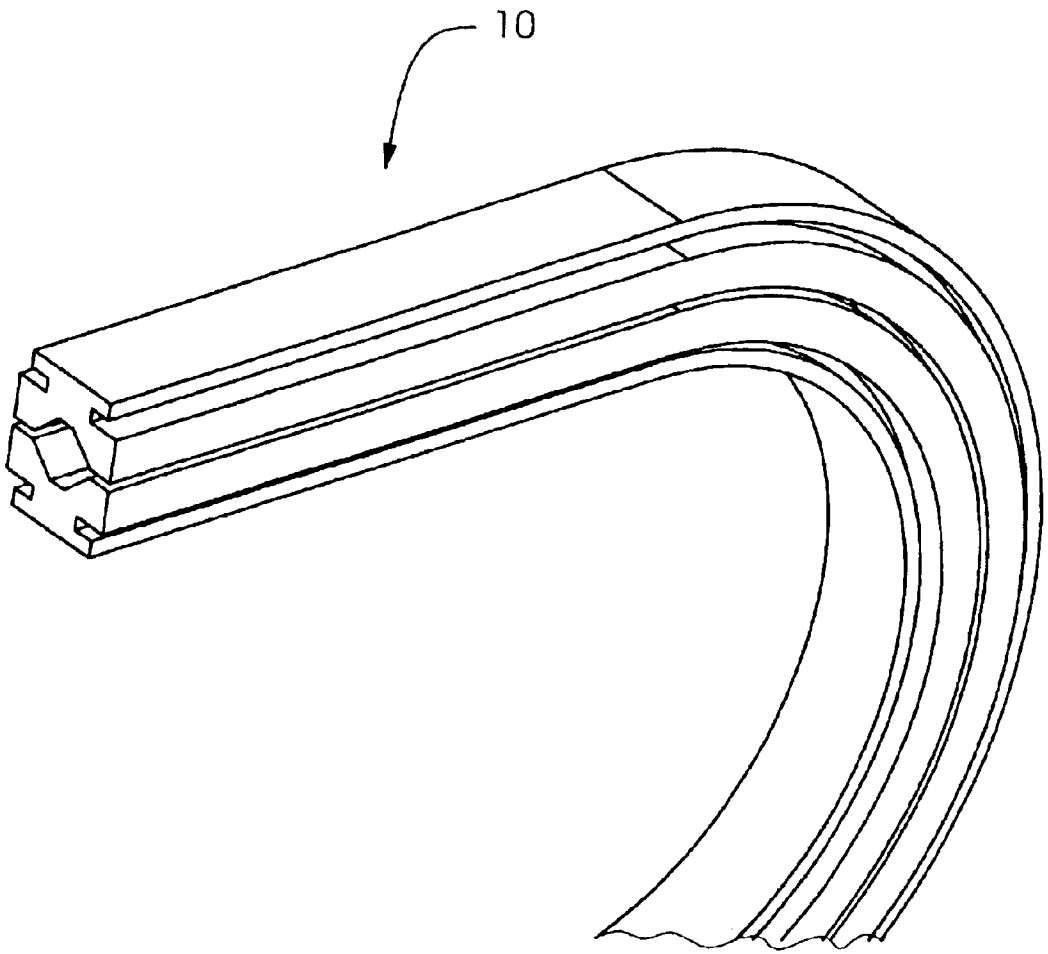
Fig. 1 (PRIOR ART)
FIG. 1 shows view of a guide according to the prior art.
Figure 2:
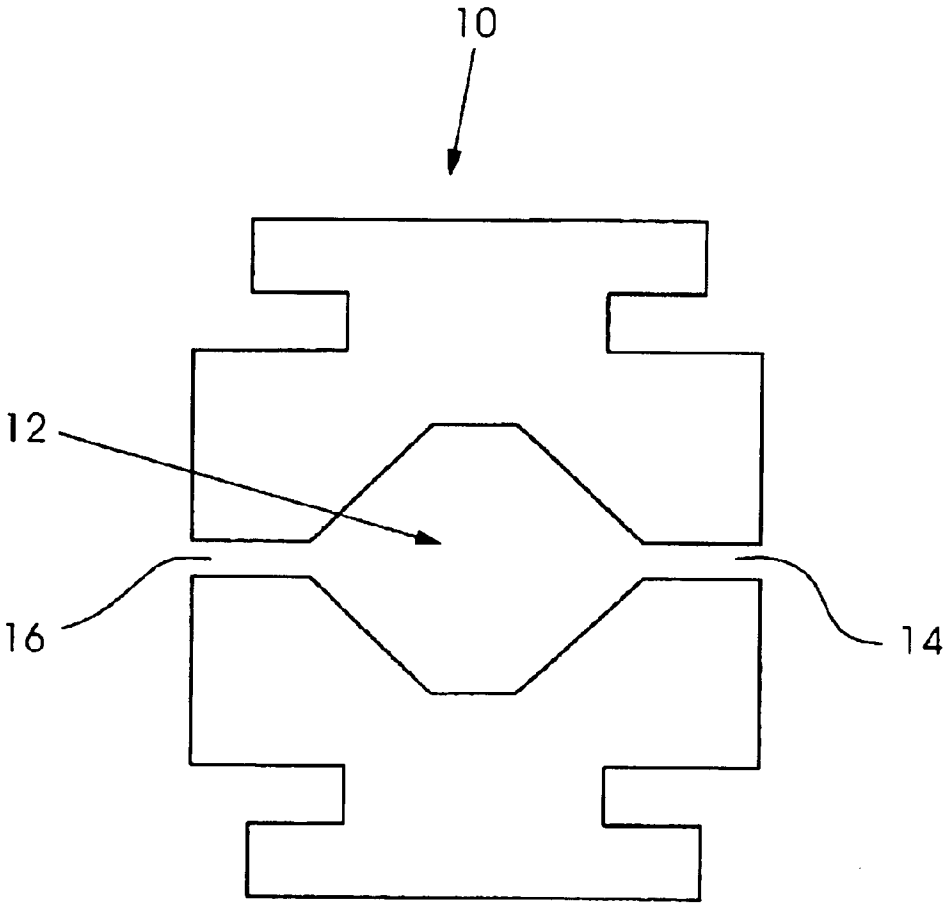
Fig.2 (PRIOR ART)
FIG. 2 shows a cross-sectional view of the guide of FIG. 1.

FIG. 1 shows a prior art guide 10, similar to example to the guide shown in incorporated-by-reference U.S. Pat. No. 5,967,036. As shown in FIG. 2, guide 10 has a hexagonally-shaped guide area 12 with band-shaped section receiving areas 14, 16 extending from the sides of area 12.

Figure 3:
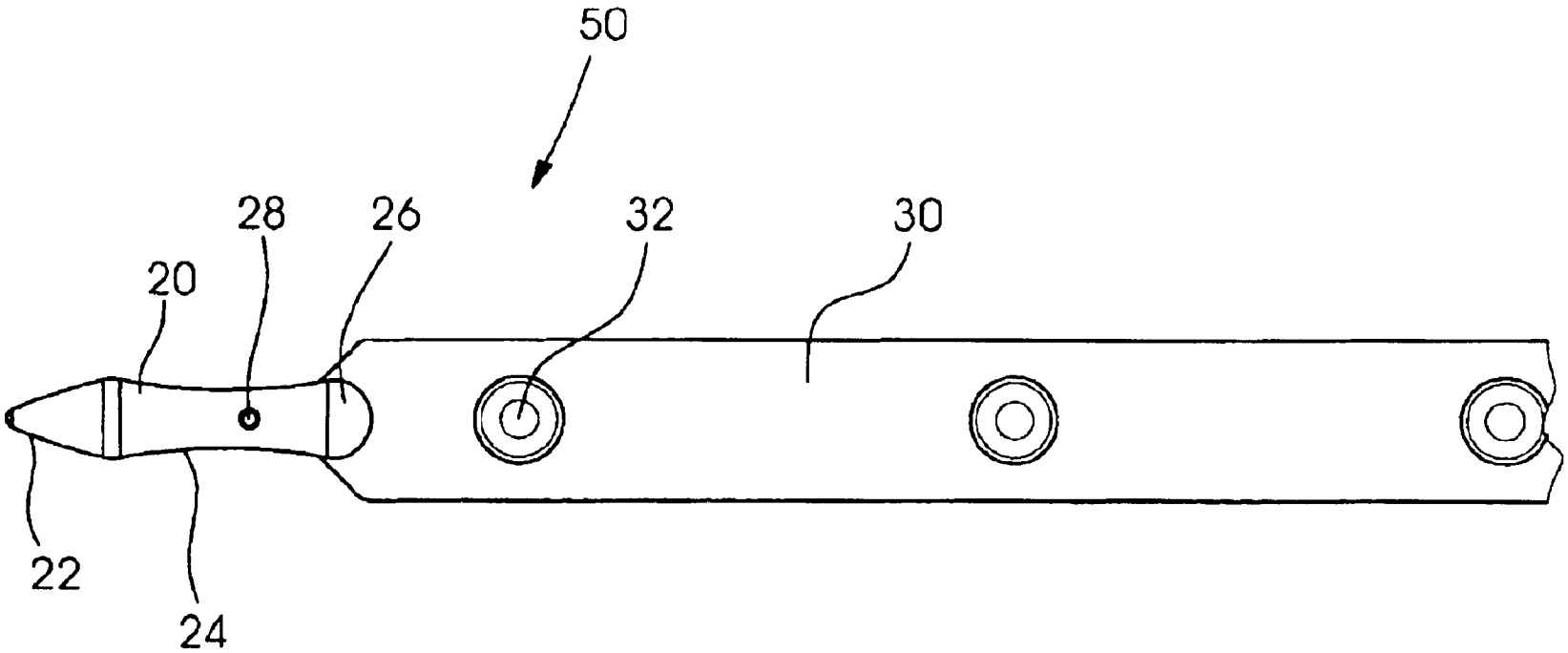
FIG. 3 shows a top view of one embodiment of an infeed element of the present invention.

FIG. 3 shows a top view of one embodiment of an infeed element 50 of the present invention. Infeed element 50 includes a flexible band-shaped section 30, for example made of metal tape, and has holes through which balls 32 pass. Infeed element 50 also includes a nose piece 20, preferably made of a rigid material. Nose piece 20 has a tapered, in other words pointed, front 22, and a concave side portion 24. The rear 26 may be a spherical lobe, which can permit backward movement of the nose piece 20.

Figure 4:
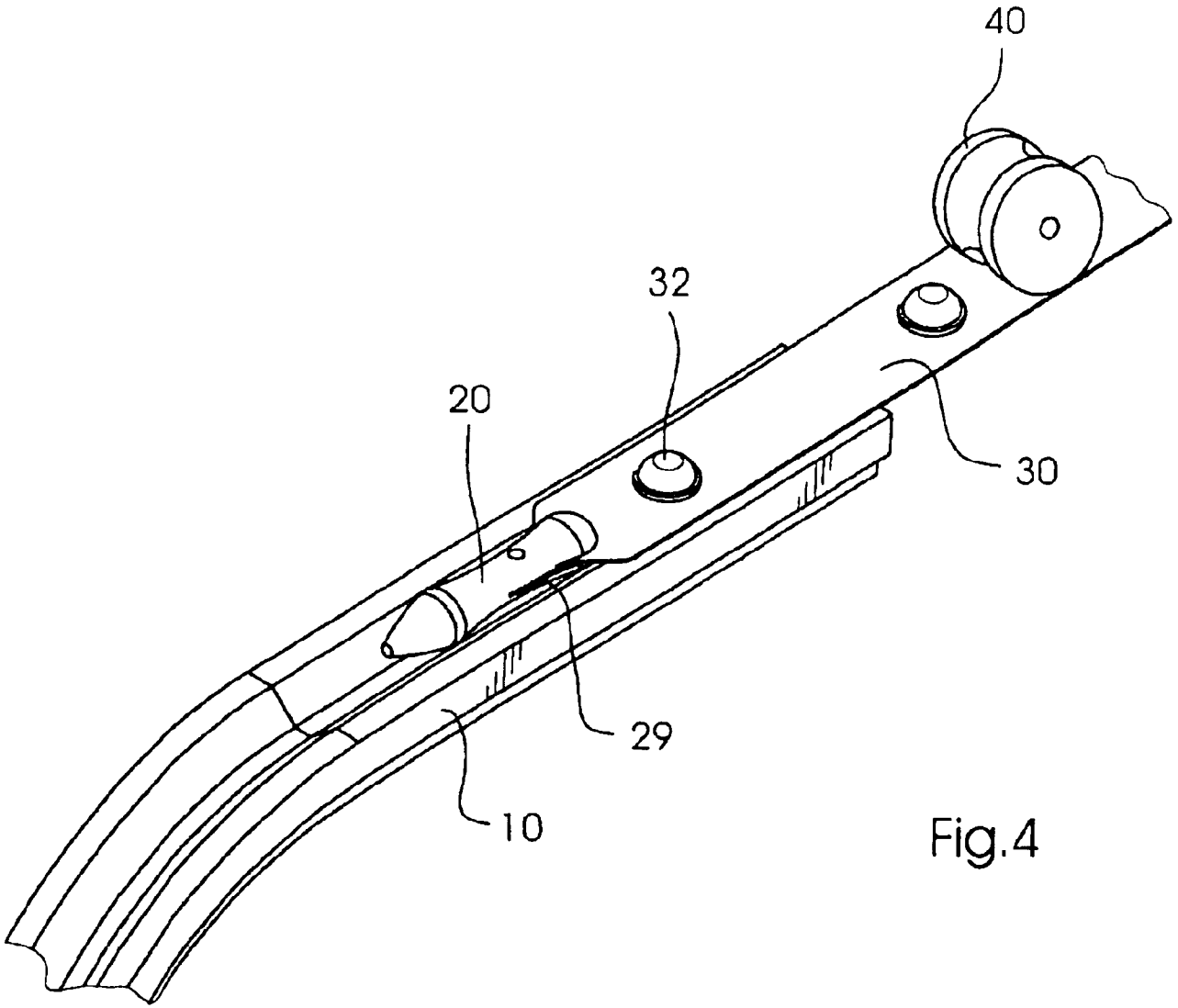
FIG. 4 shows a perspective view of the FIG. 3 embodiment.
Figure 5:
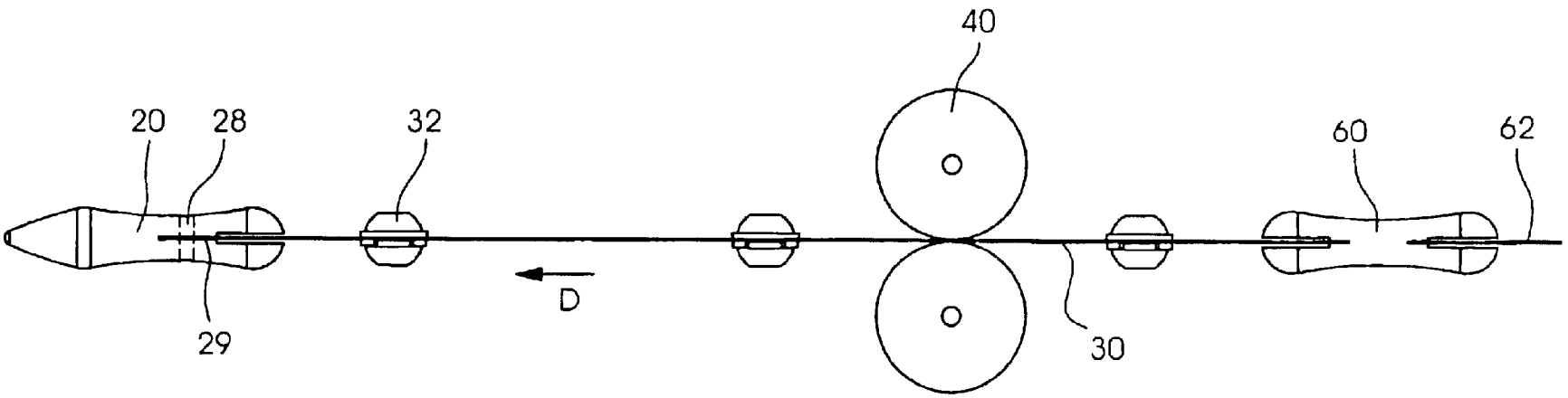
FIG. 5 shows a side view of the FIG. 3 embodiment.

As shown in FIGS. 4 and 5 as well, a tapered front end of section 30 passes through a slit 29 in the rear 26 of nose piece 20, and is fastened to nose piece 20 by a pin 28. A driving element 40 is provided in a cut out in guide or track 10. Driving element 40 has a hollow section through which the nose piece 20 and balls 32 may pass, and nips the edges of the section 30 against the guide 10 to move the flexible band-shaped section 30 and nose piece 20 in direction D. A connecting piece 60 may be provided to connect a second flexible band-shaped section 62 to section 30. Connecting piece 60 with concave side potions also may pass through the hollow section of driving element 40. A plurality of driving elements 40 are spaced along guide 10.

Figure 6:
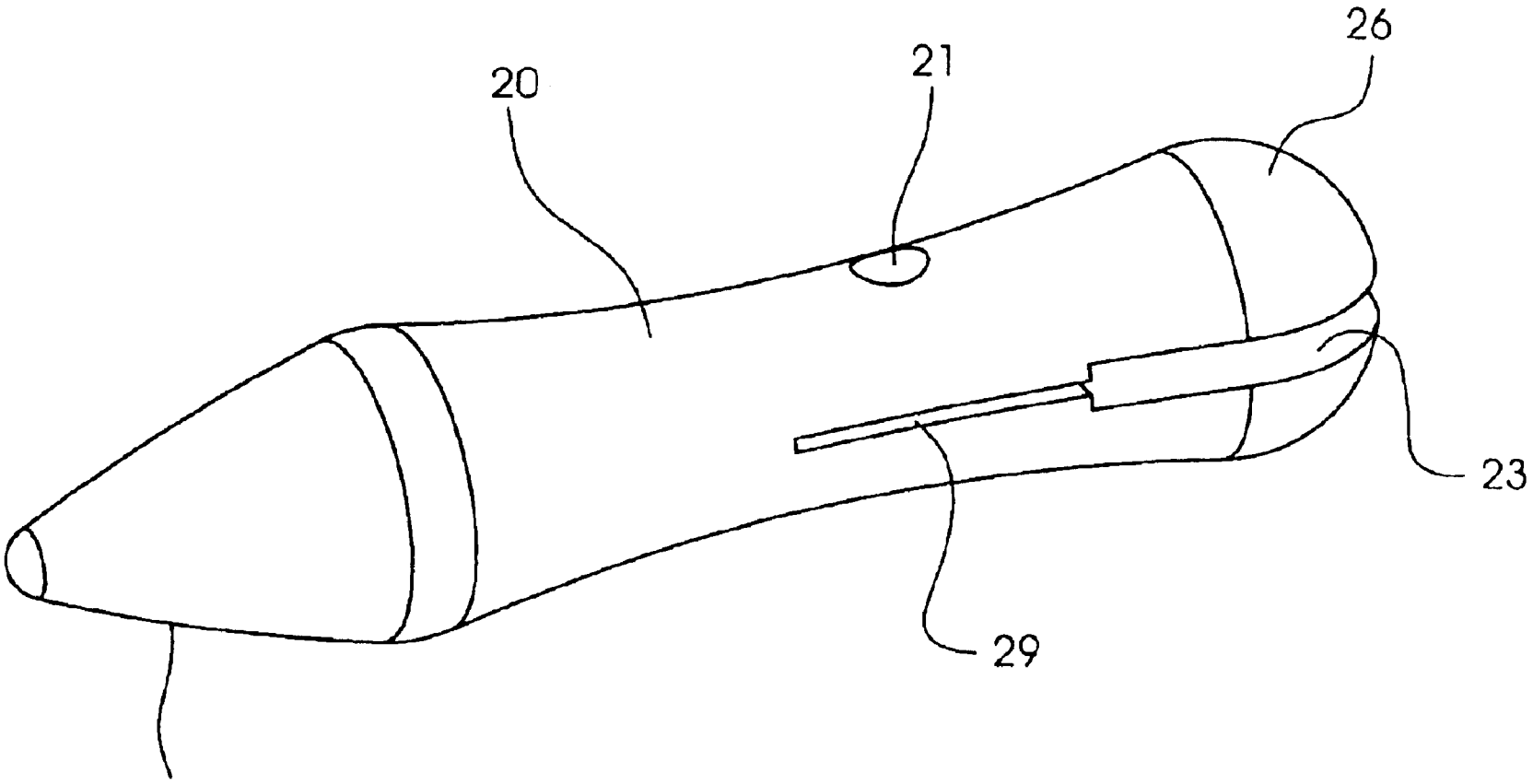
FIG. 6 shows the nose piece of the FIG. 3 embodiment.

FIG. 6 shows the nose piece in more detail, with a hole 21 being provided for pin 28. Pin 28 and hole 21 may be threaded for example. Slit 29 in rear 26 may include a wider section 23, which permits flexible band-shaped section to bend with respect to nose piece 20 when passing curves in guide 10.

Figure 7:
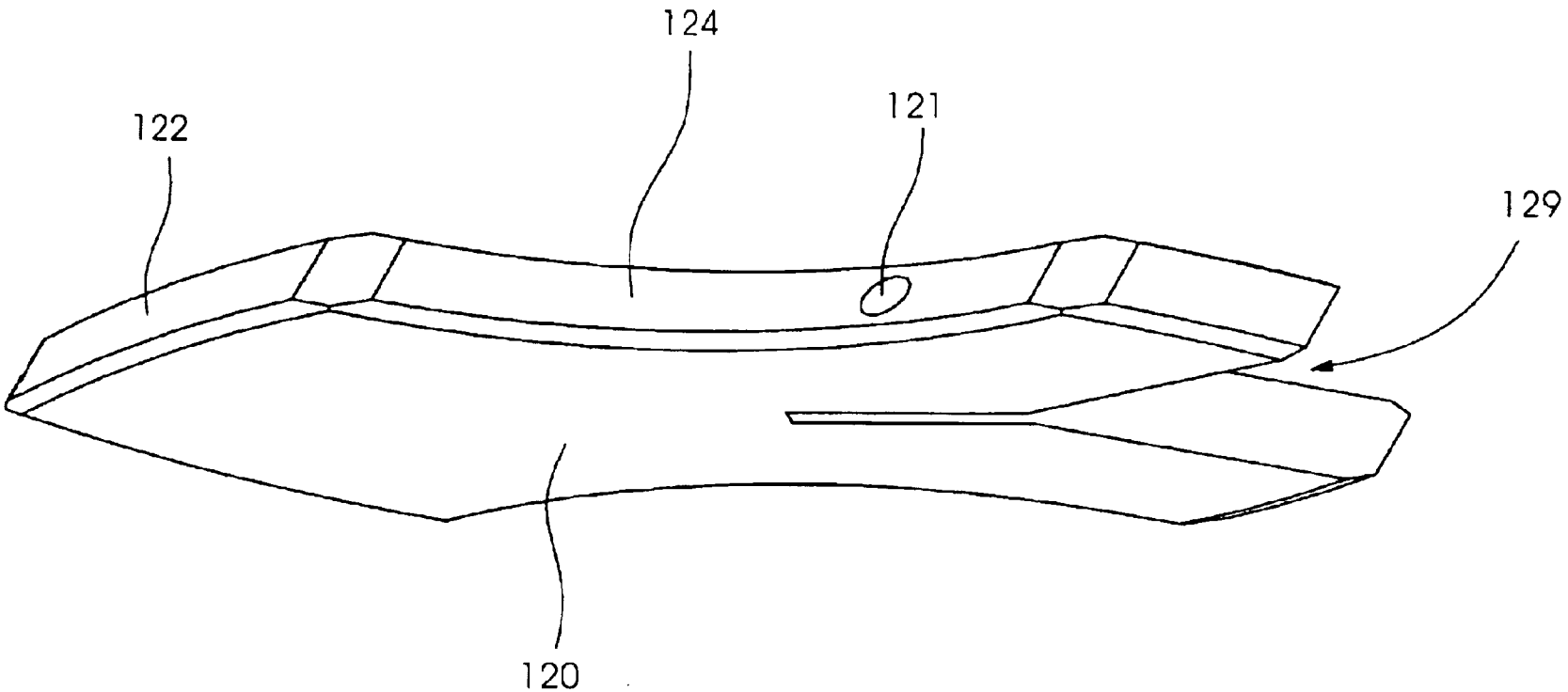
FIGS. 7 and 8 show alternate embodiments of the nose piece of the infeed element.

FIG. 7 shows an alternate embodiment of nose piece 20. Nose piece 120 has a pointed front end 122, concave side portions 124, a pin hole 121 and a rear slit 129.

Figure 8:
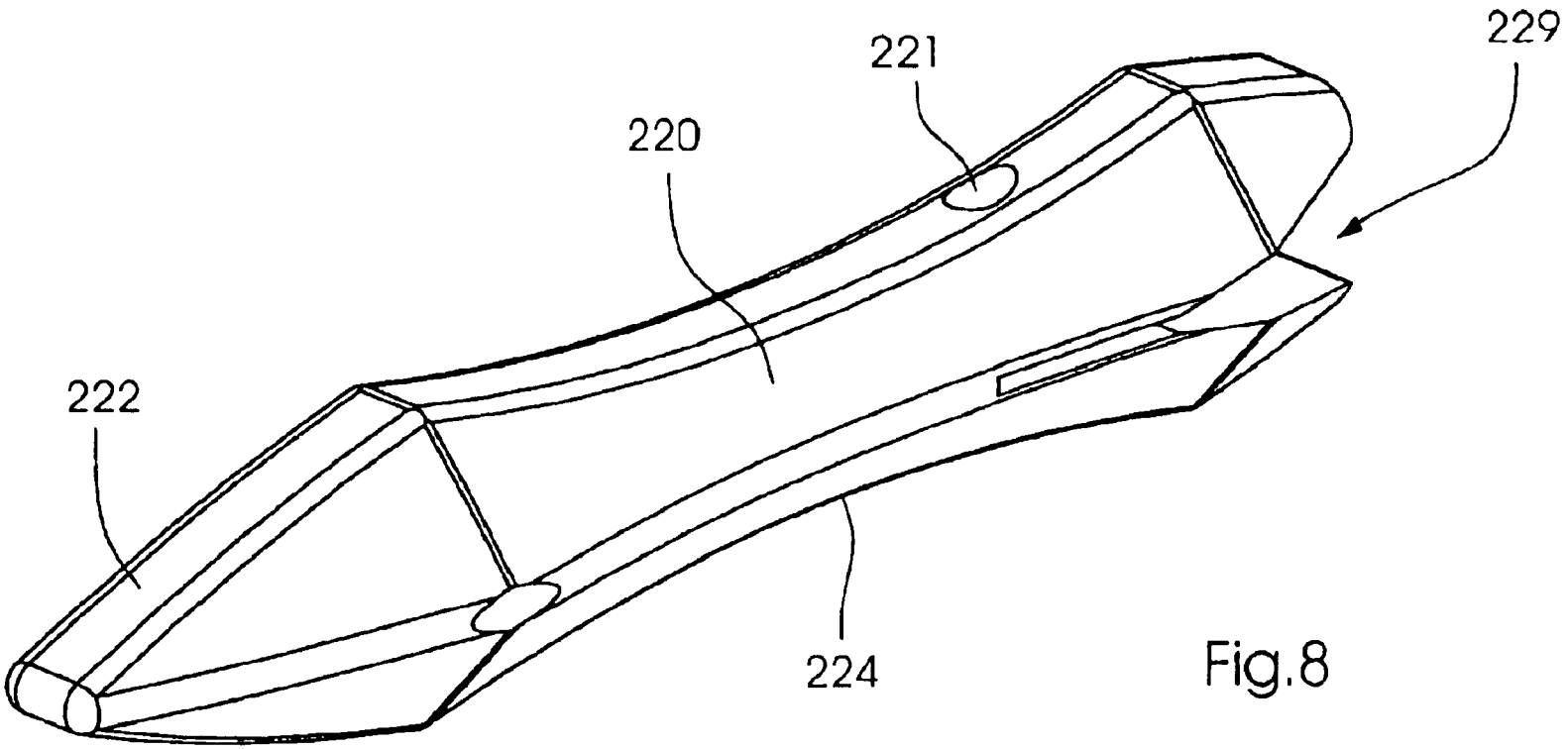

FIG. 8 shows another alternate embodiment of nose piece 20. Nose piece 220 has a pointed front end 222, concave side portions 224, a pin hole 221 and a rear slit 229.

Figure 9:
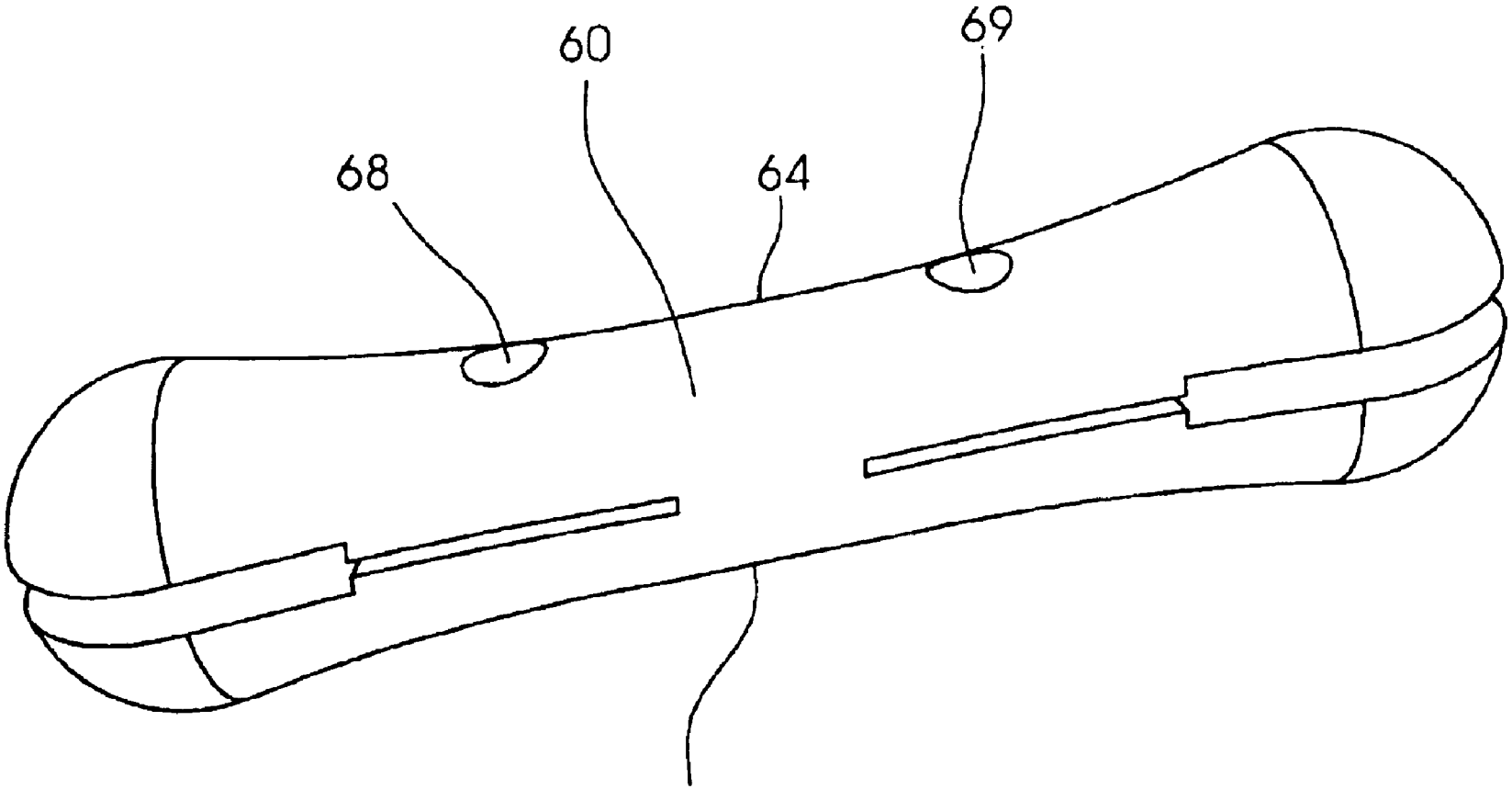
FIG. 9 shows the connecting piece of the present invention.

FIG. 9 shows the connecting element 60 with concave side portions 64, 66 and pin holes 68 and 69 for fastening the two flexible sections.

"Pointed" as defined herein means any tapered section, and can include a spherical or bulbous section.

The concave side portions of the present permit the nose piece to negotiate curves without creating excess friction, and also reduce friction during normal travel of the nose piece.

What is claimed is:

1. A web infeed device for rotary printing presses comprising:

an infeed element having a flexible band-shaped section and a rigid pointed nose piece connected to the flexible band-shaped section;

a guide having track curves, the infeed element being received in the guide;

the nose piece having rigid concave side portions, the concave side portions having two ends contacting the track, the concave side portions negotiating the track curves of the guide; and driving elements for driving the infeed element along the guide.

2. The device as recited in claim 1 wherein the flexible band-shaped section includes a flat band-shaped metal piece.

3. The device as recited in claim 1 wherein the flexible section includes holes, and balls located in the holes.

4. The device as recited in claim 1 wherein the nose piece has a cut out at a rear end for receiving the flexible section.

5. The device as recited in claim 1 wherein the nose piece has a curved rear section.

6. The device as recited in claim 1 wherein the nose piece is symmetrical about a longitudinal plane, the flexible section defining the longitudinal plane.

7. The device as recited in claim 1 wherein the nose piece is fully symmetrical about a longitudinal axis at least in the region of the concave side portions so as to define a circular cross section perpendicular to the longitudinal axis.

8. A web infeed device for rotary printing presses comprising:

an infeed element having a flexible band-shaped section and a rigid pointed nose piece connected to the flexible band-shaped section, the nose piece being fully symmetrical about a longitudinal axis forward of the flexible section so as to define a circular cross-section perpendicular to the longitudinal axis;

a guide having track curves, the infeed element being received in the guide; the nose piece having rigid concave side portions, the concave side portions negotiating the track curves of the guide; and driving elements for driving the infeed element along the guide.

9. The device as recited in claim 8 wherein the flexible section is metal.

10. The device as recited in claim 8 wherein the flexible section includes holes, and balls located in the holes.

11. The device as recited in claim 8 wherein the nose piece has a cut out at a rear end for receiving the flexible section.

12. The device as recited in claim 8 wherein the nose piece has a curved rear section.

13. The device as recited in claim 8 wherein the nose piece is symmetrical about a longitudinal plane, the flexible section defining the longitudinal plane.

14. A web infeed device for rotary printing presses comprising:

an infeed element having a first flexible band-shaped section, a second flexible band-shaped section, a connecting piece connecting the first band-shaped section to the second band-shaped section and a rigid pointed nose piece connected to the first band-shaped section;

a guide having track curves, the infeed element being received in the guide; the nose piece having rigid concave side portions, the concave side portions having two ends contacting the track, the concave side portions negotiating the track curves of the guide; and driving elements for driving the infeed element along the guide.

15. The web infeed device as recited in claim 14 wherein the concave side portions are fully symmetrical about a longitudinal axis so as define a circular cross section perpendicular to the longitudinal axis.

16. The device as recited in claim 1, wherein the nose piece includes a pointed front section, the concave side portions of the nose piece being longer than the pointed front section.

17. A web infeed device for rotary printing presses comprising:

an infeed element having a flexible band-shaped section and a rigid pointed nose piece connected to the flexible band-shaped section;

a guide having track curves, the infeed element being received in the guide;

the nose piece having rigid concave side portions, the concave side portions negotiating the track curves of the guide, wherein the nose piece is fully symmetrical about a longitudinal axis at least in the region of the concave side portions so as to define a circular cross section perpendicular to the longitudinal axis; and driving elements for driving the infeed element along the guide.

* * * * *